US008491781B2

(12) United States Patent
Gauthier et al.

(10) Patent No.: US 8,491,781 B2
(45) Date of Patent: Jul. 23, 2013

(54) REACTION ZONE COMPRISING TWO RISERS IN PARALLEL AND A COMMON GAS-SOLID SEPARATION ZONE, FOR THE PRODUCTION OF PROPYLENE

(75) Inventors: Thierry Gauthier, Brignais (FR); Vincent Coupard, Valencin (FR); Jan Verstraete, Lyons (FR); Romain Roux, Rueil-Malmaison (FR)

(73) Assignee: IFP Energies Nouvelles, Rueil Malmaison Cedex (FR)

( * ) Notice: Subject to any disclaimer, the term of this patent is extended or adjusted under 35 U.S.C. 154(b) by 607 days.

(21) Appl. No.: 12/666,129

(22) PCT Filed: May 23, 2008

(86) PCT No.: PCT/FR2008/000710

§ 371 (c)(1),
(2), (4) Date: Jun. 30, 2010

(87) PCT Pub. No.: WO2009/007519

PCT Pub. Date: Jan. 15, 2009

(65) Prior Publication Data

US 2010/0286459 A1 Nov. 11, 2010

(30) Foreign Application Priority Data

Jun. 27, 2007 (FR) ..... 07 04672

(51) Int. Cl.
*C10G 51/06* (2006.01)

(52) U.S. Cl.
USPC ..... 208/78; 208/49; 208/67; 208/22; 208/72; 208/106; 208/113; 208/118; 208/119; 208/120.01

(58) Field of Classification Search
USPC ..... 208/78, 106, 113, 118, 119, 120.01, 208/49, 67, 72, 77; 585/301, 302, 304, 648, 585/653
See application file for complete search history.

(56) References Cited

U.S. PATENT DOCUMENTS

| | | | | |
|---|---|---|---|---|
| 3,894,935 A | | 7/1975 | Owen | |
| 4,402,913 A | * | 9/1983 | McKinney | 422/110 |
| 4,853,105 A | * | 8/1989 | Herbst et al. | 208/74 |
| 5,435,906 A | * | 7/1995 | Johnson et al. | 208/78 |
| 5,770,043 A | * | 6/1998 | Ellis et al. | 208/76 |

(Continued)

FOREIGN PATENT DOCUMENTS

| | | |
|---|---|---|
| EP | 0 259 155 A | 3/1988 |
| EP | 1 656 989 A | 5/2006 |
| WO | WO 99/11739 A | 3/1999 |

OTHER PUBLICATIONS

International Search Report, International Patent Application No. PCT/FR2008/000710, Date of Completion Feb. 13, 2009, Date of Mailing 02/24/200/, 3 pages.

*Primary Examiner* — In Suk Bullock
*Assistant Examiner* — Bradley Etherton
(74) *Attorney, Agent, or Firm* — Millen, White, Zelano & Branigan, P.C.

(57) ABSTRACT

The present invention describes a reaction zone comprising at least two fluidized reactors, a principal reactor for cracking a heavy hydrocarbon cut, the other, additional, reactor for cracking one or more light cuts, the effluents from the two reactors being treated in a common gas-solid separation and quench zone. Performance is enhanced because the thermal degradation reactions in the reaction zone are controlled in an optimum manner.

22 Claims, 2 Drawing Sheets

U.S. PATENT DOCUMENTS 5,944,982 A * 8/1999 Lomas ..... 208/164
6,296,812 B1 * 10/2001 Gauthier et al. ..... 422/144
7,102,050 B1 9/2006 Lattner et al.
2005/0121361 A1 * 6/2005 Duplan et al. ..... 208/113
2006/0113217 A1 6/2006 Andreaux et al.
2007/0007176 A1 * 1/2007 Pinho et al. ..... 208/108

* cited by examiner

REACTION ZONE COMPRISING TWO RISERS IN PARALLEL AND A COMMON GAS-SOLID SEPARATION ZONE, FOR THE PRODUCTION OF PROPYLENE

FIELD OF THE INVENTION

The catalytic cracking process (FCC) can convert heavy hydrocarbon feeds with a boiling point generally of more than 340° C. into lighter hydrocarbon fractions by cracking molecules of the heavy feed in the presence of an acid catalyst.

The FCC process essentially produces gasoline and LPG (liquefied petroleum gas) as well as heavier cuts denoted LCO and HCO.

One of the co-products of FCC is propylene, which is found in abundant quantities in LPG. The propylene may be separated from the other gases which are produced to supply a petrochemicals complex. For a number of years, the huge increase in demand for propylene has prompted refiners to produce more and more propylene by catalytic cracking. One known solution consists of cracking a hydrocarbon cut which is lighter than the principal feed and preferably contains a significant quantity of long chain olefins, generally with 5 carbon atoms or more (denoted C5=+), said cut deriving from the gasoline produced by cracking heavy feeds by FCC, or from a C4=+ olefins oligomerization unit, or from any other process producing long chain olefins.

That cracking may be carried out in the same reactor as that processing the heavy hydrocarbon feed, or in a dedicated reactor under operating conditions which are more favourable, for the production of significant quantities of propylene.

The aim of the present invention is to describe a reaction zone which can integrate the separation of effluents from the reactor converting the heavy cut with the separation of effluents deriving from one or more reactors dedicated to the conversion of light cuts.

The result is an improvement in the function of the heavy cut conversion reactor as the circulation of gas in the dilute phase in this reactor is kept under control and it is no longer necessary to flush this low circulation zone with steam to eliminate dead zones.

The invention also advantageously allows the quench for the light cut conversion reactor or reactors to be used to quench the effluents from the heavy cut conversion reactor.

In the remainder of the text, the fluidized bed catalytic cracking reactor, which is in the form of an elongate tube and operates using a transported bed, will be termed a riser, to use the terminology of the skilled person. This term generally describes a reactor in which the flow of gas and catalyst is as an ascending co-current. It is also possible to carry out the reactions in the same elongate tubular reactor operating in transported bed mode but in which the gas and the catalyst flow as a downflow. In the remainder of the text, for simplification the term "riser" will be used, this term including the possibility of operating as a dropper.

The principal feed from a heavy cut FCC unit is generally a hydrocarbon or a mixture of hydrocarbons essentially (i.e. at least 80%) containing molecules with a boiling point of more than 340° C. This feed contains limited quantities of metals (Ni+V), generally less than 50 ppm, preferably less than 20 ppm, and a hydrogen content which is generally more than 11% by weight. It is also preferable to limit the nitrogen content to below 0.5% by weight.

The quantity of Conradson carbon in the feed (defined by American standard ASTM D 482) to a large extent determines the dimensions of the FCC unit to satisfy the thermal balance.

Depending on the Conradson carbon in the feed, the yield of coke means that the unit dimensions must be specific in order to satisfy the thermal balance. Thus, if the Conradson carbon of the feed is less than 3% by weight, it is possible to operate the FCC unit, satisfying the thermal balance by burning coke in a total combustion fluidized bed.

For heavier feeds with a Conradson carbon of more than 3% by weight, other solutions may be applied which can satisfy the thermal balance, such as partial combustion regeneration, a combination of partial regeneration in the absence of air with regeneration with an excess of air, or the double regeneration of the R2R process.

The injection of recycled cracked cuts into the riser which on vaporization absorbs excess heat is also a possible solution to satisfying the thermal balance. Finally, putting in exchangers (generally termed a cat cooler in the art) into the regeneration zone can absorb part of the excess heat, for example by producing vapour and cooling the catalyst.

By using one or more of the above techniques, it is possible to convert, by catalytic cracking, heavy cuts with a Conradson carbon of less than 15% by weight, preferably less than 10% by weight.

The catalytic cracking of heavy cuts produces effluents which range from dry gases to conversion residues. The following cuts are classified as effluents, and are conventionally defined as a function of their composition or their boiling point:

- dry and acid gases (essentially: $H_2$, $H_2S$, C1, C2);
- liquefied petroleum gases containing C3-C4 molecules;
- gasolines containing heavier hydrocarbons with a boiling point of less than 220° C. (standard cut point);
- gas oils with a standard 220-360° C. boiling range, which are highly aromatic and thus termed LCO (light cycle oil);
- conversion residue, with a boiling point of more than 360° C.

it is possible to recycle certain of those cuts to re-crack them catalytically.

It is also possible to recycle cuts directly produced by FCC, or cuts produced by FCC but which have undergone subsequent transformations. As an example, it is possible to crack the light gasoline from FCC, with a boiling point range of C5-150° C., and rich in olefins, to favour the production of propylene.

It is also possible to separate from the effluents a cut which is rich in C4-5 molecules, to oligomerize the olefins in that cut and then to crack the oligomerates.

It is also possible to envisage recovering LCO, hydrogenate it then crack that cut which by then exhibits modified properties which are more favourable to catalytic cracking.

Many combinations are possible. It is also possible to envisage injecting into the FCC light cuts deriving from other processes to convert them catalytically. Thus, as an example, it is possible to envisage catalytically cracking petrochemical naphthas.

It is also possible to envisage catalytically cracking light hydrocarbon cuts deriving from vegetable or animal sources. Such feeds are constituted by all vegetable oils and animal fats essentially containing triglycerides and fatty acids or esters, with hydrocarbon fatty chains containing 6 to 25 carbon atoms. These oils may be African oil, palm nut oil, coprah oil, castor oil or cottonseed oil, peanut oil, linseed oil and crambe oil, coriander oil, and any oil deriving, for example, from sunflowers or rapeseed or by genetic modification or hybridization.

Frying oils, various animal oils such as fish oils, tallow or suet may also be used.

These feeds are almost or totally free of sulphur-containing and nitrogen-containing compounds containing no aromatic hydrocarbons.

Advantageously, this type of feed, vegetable oil or animal fat, may initially undergo prior to its use in the process of the invention, a step for pre-treatment or pre-refining to eliminate various contaminants using a suitable treatment.

Catalytic cracking of light cuts, defined as containing at least 80% by weight of molecules with a boiling point of less than 340° C., and including the vegetable oils and animal fats of the preceding paragraph, can significantly modify the yield structure of a heavy cut FCC:

- firstly, selectivity is displaced. As an example, by oligomerizing a C4-C5 cut which is then cracked, indirect conversion of the C4-C5 cuts is carried out to produce a C3 cut which is rich in olefins;
- secondly, the heat of reaction of the light injected cut modifies the thermal balance of the unit by absorbing heat, which encourages the circulation of catalyst as the quantity of coke formed is smaller than for the heavy cuts. The C/O ratio is improved and catalytic conversion of the heavy cut is encouraged.

EXAMINATION OF THE PRIOR ART

The skilled person is aware that catalytic cracking of light cuts is encouraged by conditions which are generally more severe than that for heavy cuts.

The term "more severe conditions" means a higher cracking temperature, a higher circulation of catalyst, and a longer residence time.

By way of example, to effectively crack a gasoline, which is considered to be a light cut, the conditions regarding temperature (typically 530-700° C.), C/O (typically 10-30), and residence time (1 s-30 s) are considerably more severe than those used for the cracking of heavy cuts.

The combination of two independent reaction zones allowing different oil cuts to be cracked under differing conditions of severity is known to the skilled person. It is thus possible to crack, in a principal reactor, a heavy hydrocarbon cut producing large quantities of gasolines and LPG, and to re-crack, in a dedicated secondary reactor, part of the gasoline which is produced containing long chain C5+ olefins which are particularly reactive in the production of propylene.

It is also possible to re-crack in a dedicated secondary reactor, a portion of the C4-C5 olefins, which have previously been oligomerized to form long-chain olefins.

Said re-cracking can considerably increase the production of propylene, without deteriorating the overall gasoline yield, if the cut recycled to the secondary reactor is constituted by particularly reactive oligomerates from C4-C5 cuts.

The skilled person is also aware that supplementing the FCC catalyst (essentially constituted by USY zeolite encouraging catalytic cracking towards the production of gasoline) with particular zeolites with form selectivity, such as ZSM-5, can encourage the production of propylene.

At the riser outlet, the gaseous effluents are separated from the particles of catalyst to stop the catalytic reactions and to rapidly evacuate the gaseous effluents from the reactor.

It is also possible to limit the thermal degradation of effluents resulting from their prolonged exposure to a temperature level close to that encountered at the riser outlet as far as possible. To this end, gas-solid separation techniques have been developed to encourage rapid disengagement of gas effluents and catalyst at the riser outlet.

Thus, European patent EP-A-1 017 762 describes a gas-solid separation system comprising a set of separation chambers and stripping chambers arranged in an alternating manner around the riser. This system can simultaneously carry out the following operations:

- separation of gas and particles in the separation chambers;
- introducing into the stripper most of the catalyst separated in the separation chambers through lines minimizing the entrainment of hydrocarbons;
- the passage of gas from the separation chambers into the stripping chambers which can complete separation between the gas and the particles of catalyst, and mix said gas with effluents deriving from the stripper;
- rapid evacuation of all of the gaseous effluents deriving from the stripper and the stripping chambers to the reactor cyclones for final separation before leaving the reactor.

It is also possible to quench the reaction effluents to limit the thermal degradation of effluents from a FCC reaction zone. Thus, patents U.S. Pat. No. 5 089 235, U.S. Pat. No. 5 087 427, U.S. Pat. No. 5 043 058 and WO-91/14752 describe devices which can reduce the temperature downstream of the reaction zone and thus limit thermal cracking reactions. Thus, downstream of gas-particle separation, it is possible to inject a hydrocarbon which vaporizes in contact with effluents from the reaction zone and thus cools the medium. This injection may be made into the outlet for gases from the separator, or into the dilute phase of the reactor.

BRIEF DESCRIPTION OF THE INVENTION

Figure 1:
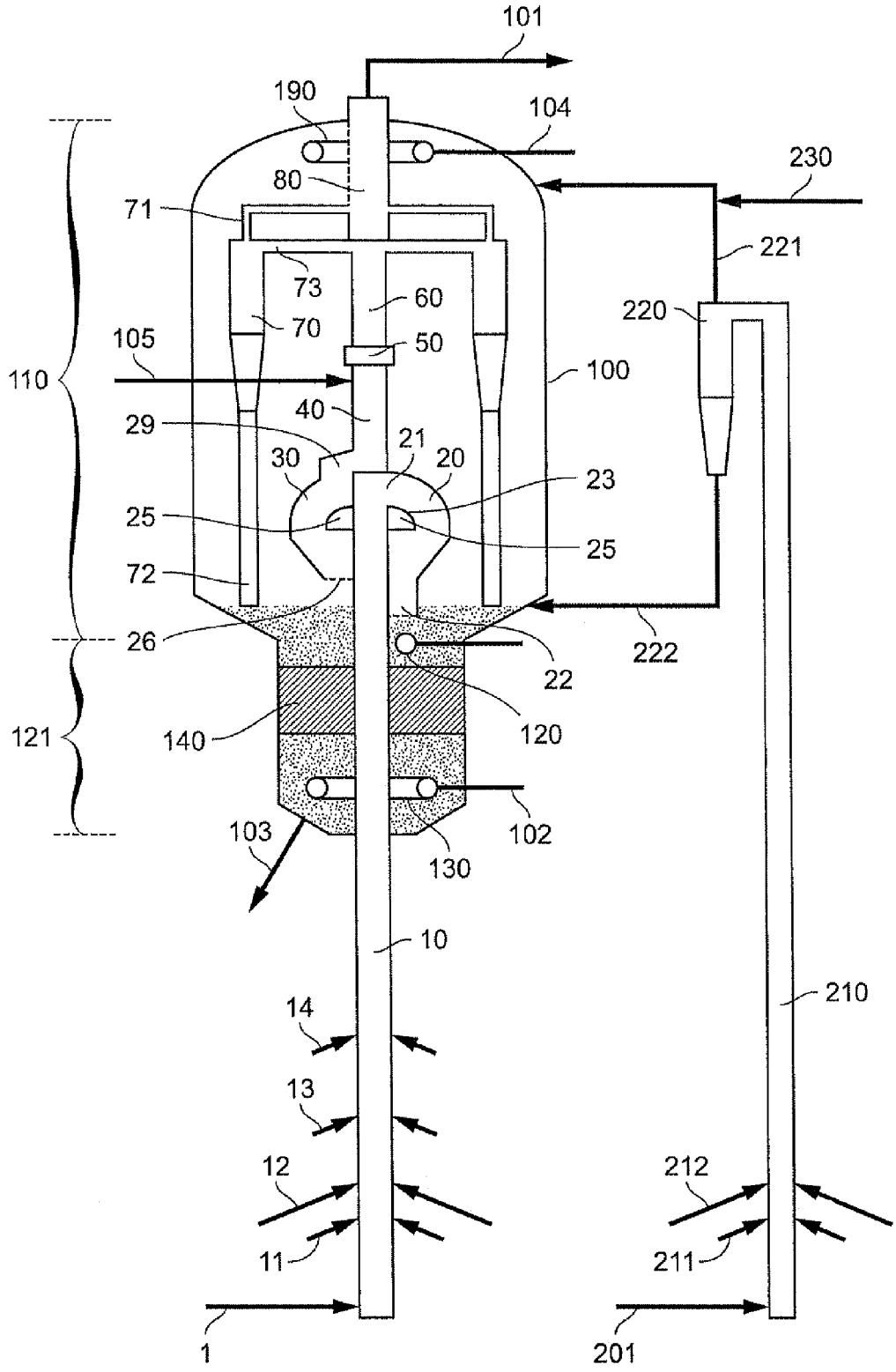
FIG. 1, in accordance with the invention, describes a reaction zone comprising two risers, a principal riser for cracking a heavy cut and an additional riser for cracking a light cut. The gas-solid effluents from the additional riser are discharged into the principal reactor in two fractions, one of which is essentially gaseous, into the dilute phase of said principal reactor where it mixes with the effluents from the principal riser, the other of which is essentially solid, into the dense phase of the principal reactor.

The present invention may be described as a reaction zone comprising:

- a principal reactor (100) carrying out catalytic cracking of a heavy feed, comprising a dilute phase zone (110) containing a) the upper portion of the principal riser (10) terminated by a rapid separation system (20, 30) followed by a secondary separation system (70); b) a device for injecting a quench fluid (105) located between the rapid separation system and the secondary separation system; c) a device for injecting a flush fluid (104) located in the upper portion of the dilute phase (110), the lower portion of said principal reactor (100) further comprising a dense phase zone (121) allowing the catalyst to be stripped;
- one or more additional risers (210) operating at higher severity than the principal riser (10) and carrying out catalytic cracking of light cuts, said additional risers (210) operating in parallel to the principal riser (10);

the gaseous and solid effluents from the additional riser or risers (210) being sent to the dilute zone (110) of the principal reactor (100).

The term "gaseous and solid effluents" from the additional riser or risers means the set formed by gaseous reaction effluents from the additional riser or risers and the catalyst circulating in the additional riser or risers.

In a preferred variation of the present invention, the effluents from the additional riser or risers (210) are initially separated into a mainly gaseous phase containing the reaction effluents (221), and a mainly solid phase containing the cracking catalyst (222), the gas phase being sent to the dilute phase zone (110) of the principal reactor (100), and the solid phase being sent to the dense phase zone (121) of the principal reactor (100).

In a preferred variation of the present invention, most, i.e. more than 70% and preferably more than 80%, of the quench fluid for controlling the temperature of the effluents from the reaction zone is constituted by the quench fluid (230) injected with the effluents (221) from the additional riser or risers.

In a further preferred variation of the present invention, most, i.e. more than 70%, preferably more than 80%, of the flush fluid which keeps a certain current in the dilute phase zone (110) of the principal reactor (100) is constituted by effluents (221) from the additional riser or risers.

This means that in the reaction zone of the invention, the characteristics are such that the temperature (T5) of the dilute phase zone (110) of the principal reactor (100) is generally in the range 490° C. to 520° C., and the residence time for the reagents measured from introduction of the heavy feed into the bottom of the principal riser (10) to the outlet for the reaction effluents from the principal reactor (100) is generally less than 10 seconds.

The present invention may also be described as a process for producing propylene using a reaction zone in accordance with the invention, in which the feed for the principal riser is a heavy cut, and the feed for at least one of the additional risers is a light cut containing at least 30% by weight of olefins, wherein at least 80% of the molecules have a boiling point of less than 340° C.

In a variation of the present invention, the feed for at least one of the additional risers is a light gasoline (C5-150° C.) produced in the principal riser and containing at least 30% olefins.

In a further variation of the present invention, the feed for at least one of the additional risers is an oligomerized gasoline produced from C4 or C5 light olefins derived from the principal riser.

Finally, in another variation of the invention, the feed for at least one of the additional risers may also be a vegetable oil or an animal fat or any mixture of vegetable oil and animal fat.

The reaction zone of the invention is compatible with a vertical downflow in the principal reactor and the additional riser or risers. In this case, usually, the term "riser" is replaced by that of "dropper". In order to keep the terminology simple, however, the term "riser" will be used for the particular case of a downflow.

Similarly, the expressions "dilute phase zone (110)" and "dense phase zone (121)" are respectively replaced by "dense zone (110)" and "dilute zone (121)".

One of the hydrodynamic consequences of the reaction zone of the invention is that it becomes possible to use the effluents from the additional riser or risers as a quench fluid for the effluents from the principal reactor. Thus, most, i.e. more than 70% and preferably more than 80%, of the quench fluid from the principal reactor is injected with the effluents (221) from the additional riser or risers. It is also possible in a particular case for all of the quench fluid (230) to be injected with the effluents from the additional riser or risers.

Another hydrodynamic consequence of the reaction zone of the invention is that it is possible to dispense with the flush fluid (104) into the dilute phase of the principal reactor.

One aim of the present invention is to allow simultaneous control of the residence time for effluents from the principal riser (10) and the additional riser or risers (210), by producing, using the common rapid separation system, a short residence time for all of the effluents.

The invention also aims to improve the function of the principal reactor (100) by an intense flushing of the dilute phase (110) of said principal reactor (100) under controlled temperature conditions.

Finally, another advantage of the present invention resides in the fact that the gaseous effluents from the principal riser (10) are more effectively confined in the rapid separator and cannot escape from the dilute zone (110) located around said rapid separator, which constitutes a guarantee of better control of the residence time for these effluents in the rapid separation system.

DETAILED DESCRIPTION OF THE INVENTION

For clarity in the description below, the term "reaction zone" will be used for the assembly constituted by the principal riser acting to catalytically crack a heavy hydrocarbon cut, the additional riser or risers acting to crack light hydrocarbon cuts under conditions which are more severe than those for cracking the heavy cut, and the rapid separation system located at the end of the principal riser and which is common to the riser assembly.

The term "reactor", or sometimes the "principal reactor" to avoid ambiguity, denotes the assembly formed by the upper portion of the principal riser, the rapid separation system installed at the outlet from the principal riser, the cyclones connected to the rapid separation system and the dense stripping bed located in the lower portion of the reactor (also termed the stripper).

The reactor defined in this manner is contained in a chamber (100) which thus comprises a dilute zone denoted (110) and a dense zone, or stripper, denoted (121). For simplification, the reactor will be identified by the chamber (100) which defines it.

The reaction zone of the present invention may thus be defined as a combination of the principal reactor (100) and the additional riser or risers (210).

The present invention thus describes a reaction zone constituted by a principal riser (10) which can carry out catalytic cracking of a heavy hydrocarbon cut (hereinafter termed the heavy feed) and one or more additional risers (210) which can crack light cuts, these cuts possibly being naphthas of any origin, partially unsaturated hydrocarbons such as C4 or C5 olefins, which may previously have been oligomerized, or finally vegetable oils or animal fats.

The reaction zone of the invention is characterized by the fact that separation of gas-solid effluents deriving from the principal riser and the additional riser or risers is carried out using a common rapid separation system.

This common rapid separation system is installed at the outlet from the principal riser (10) for cracking the heavy feed.

FIG. 1 shows one implementation of the reaction zone of the present invention. The principal riser (10) terminates in a rapid separation system comprising a flushing device (104) and a device (105) for quenching effluents.

To optimize the function of this rapid separator, it is necessary to have a sufficient flow rate of gas from the stripper (120) through openings (26) connecting the stripping chambers (30) to the dilute zone (110) of the principal reactor (100).

The stream of gas ascending through these openings (26) allows hydrocarbons deriving from the riser (10) to be contained in the stripping chamber (30). More precisely, it can prevent effluents from the riser (10) from penetrating into the dilute zone (110), a zone with a low circulation rate in which they may stay for a long period and degrade thermally because of the relatively high temperatures prevailing in said dilute zone (110).

Further, because of the thermal losses out through the walls of the dilute zone (110) of the reactor, this may result in significant cooling of the walls of said zone (110) compared with the high rate flow zones (20, 30, 40, 50, 60, 73, 70).

This cooling may be by as much as a hundred degrees, and may cause the formation of coke on the cold walls in question, more precisely in a zone where the circulation rate for gas is low. To avoid this phenomenon, which may result in stoppage of the unit, it is possible to inject a gaseous fluid into the top of the reactor (104), which would constantly renew the gas volume in the zone (110) and thus avoid the accumulation of hydrocarbons which might thermally degrade.

The gas injected into the top of the reactor (104), termed flush gas, is generally steam, but it may also be another light gas which does not thermally degrade under the conditions encountered in the dilute zone (110), i.e. typically 400-550° C.

The present invention offers a solution which can replace a large part or even all of the flush gas (104) by gaseous effluents derived from the additional riser or risers (210) in which high severity cracking of light cuts occurs.

The remainder of the text is a description of the principal riser (10) and the rapid separation system contained in the dilute zone (110) of the principal reactor (100).

Regenerated catalyst (1) from the regeneration zone (not shown in FIG. 1) is introduced at the lower end of the riser (10). The catalyst is kept in the fluidized state by aeration gas which cannot condense under the temperature and pressure conditions at the bottom of the riser (10). It may be accelerated to optimize contact with the heavy feed by injection (11) of an essentially gaseous fluid (steam, light hydrocarbon).

The heavy feed is introduced into the reaction zone in contact with the catalyst using means (12) which can atomize said feed in the liquid state into fine droplets. It is possible to introduce an essentially liquid fluid using means (13, 14) disposed downstream (in the direction of flow of the reaction fluids) of the injection point for the heavy feed (12). On vapourizing, this liquid (13), (14) will reduce the temperature of the reaction medium which will allow the temperature profile along the riser (10) to be optimized.

Under the effect of the cracking reactions, an axial velocity profile is established which can transport the catalyst over the whole length of the riser (10).

At the outlet from the riser (10), the gaseous hydrocarbons and the catalyst are separated in a rapid separation device (20, 30) constituted by an arrangement of one or more separation chambers (20) alternating with one or more stripping chambers (30) disposed around the upper end of the riser (10).

The gas-solid mixture deriving from the riser (10) penetrates into the separation chamber (20) via the inlet section (21), and under the effect of centrifugal force, solid particles migrate towards the outer walls of the separation chamber (20) thus allowing the gas to disengage. The solid particles leave the separation chamber (20) via downwardly orientated outlets dedicated to the catalyst (22) and join to the dense stripping bed (121).

The gas turns around a deflector (23) and leaves the separation chamber (20) laterally via an opening (25) allowing communication with the adjacent stripping chamber (30).

The velocity of the gas-solid mixture in the inlet section (21) of the separation chambers (20) is generally in the range 10 m/s to 40 m/s, and preferably in the range 15 m/s to 25 m/s.

The surface flow rate of the catalyst in the outlet section (22) of the separation chambers (20) is generally in the range 10 kg/s.m$^2$ to 300 kg/s.m$^2$, and preferably in the range 50 kg/s.m$^2$ to 200 kg/s.m$^2$, to limit unwanted entrainment of hydrocarbon vapour with the catalyst.

The velocity of the gas through the opening (25) is generally in the range 10 m/s to 40 m/s, preferably in the range 15 m/s to 30 m/s.

The gas passing into the stripping chamber (30) is mixed with the gas from the stripper (121) which penetrates into the stripping chamber (30) via the opening (26) located in the lower portion of the stripping chamber (30). It should be noted that gas from the stripper (121) can only be evacuated via the openings (26). Any small amount of gas derived from the stripper which would pass as a counter current to the catalyst via the outlets (22) would then find itself in the stripping chamber (30).

The gases from the stripping chambers (30) are evacuated via a common outlet (29) located in the upper portion of the stripping chambers (30) communicating via the vertical (40, 60) then horizontal (73) lines with the secondary separation system, generally constituted by cyclones (70).

It is possible to position mechanical means (50) on the vertical lines (40, 60) which can absorb the differential expansion between the top portion of the riser (10) and the lower portion of the riser (10).

The concentration of solids in the gases entering the cyclones (70) is generally of the order of 4 times smaller than in the upper portion of the riser (10).

The effluents which have been stripped following passage through the cyclones (70) are then evacuated from the reactor through lines (71, 80) and leave the principal reactor (100) via the line (101), generally placed at the top of said reactor (100).

With such a device, it is generally possible to evacuate the hydrocarbon effluents in less than 5 seconds, this time corresponding to the period spent between the outlet (21) from the riser (10) and the outlet (101) of the reactor (100). Overall, the residence time for reaction fluids from introduction into the bottom of the principal riser (10) to leaving the reactor (100) is generally less than 10 seconds.

To limit the thermal degradation of effluents when the temperature at the outlet from the riser (10) is high, it is possible to inject an essentially liquid fluid (105) downstream of the outlet (29), for example at the vertical line (40), using means for introducing said fluid (105) allowing it to vaporize rapidly, causing a significant drop in the flow temperature.

Clearly, this cooling fluid (105) may also be injected into the line (60) or the line (73).

This cooling fluid, also termed a quench fluid, is generally a hydrocarbon which can vaporize under the conditions prevailing in the zone into which it is injected. This fluid may, for example, be LCO (light cycle oil) derived from the principal cracking.

The catalyst evacuated from the separation chamber (20) via the outlet (22) flows into a stripping zone functioning as a dense fluidized bed (121), constituting the lower portion of the reactor (100), in which steam, introduced at various levels (120, 130), can fluidize the catalyst and encourage desorption of hydrocarbons adsorbed on said catalyst.

Structured or internal packing elements (140) encouraging counter current contact between the descending catalyst and the ascending vapour may be integrated at various points in the stripping zone (121). The stripping vapour and the desorbed hydrocarbons leave the stripping zone (121), going towards the diluted zone (110) of the reactor (100).

The stripped catalyst is evacuated from the stripping zone (121) via the line (103) to join the regeneration zone (not shown in FIG. 1).

All of the gases (stripping vapour (102) and (120) and the desorbed hydrocarbons) then pass via the opening (26) into the stripping chambers (30), in which an optimized ascending velocity is maintained which is generally in the range 1 m/s to 5 m/s, preferably in the range 1.5 to 4 m/s. It should be noted that this velocity influences the efficiency of the stripping chambers (30) as the interior of said stripping chambers (30) may contain gas deriving from the separation chambers (20) via the opening (25).

An additional riser with an elongate tubular form (210) is disposed substantially parallel to the principal riser (10) to carry out catalytic conversion of a light cut. FIG. 1 shows a single additional riser, but the invention encompasses the case in which a plurality of additional risers are disposed substantially parallel to the principal riser (10), each of these additional risers being capable of cracking a different light feed.

The additional riser (210) is fed with a stream of catalyst (201) deriving from the same regeneration zone (not shown in FIG. 2) as that used to regenerate the catalyst circulating in the principal riser (10).

Essentially gaseous fluids (211) may be introduced to condition the fluidized flow of the catalyst at the inlet to the riser (210). The light cut (212) to be cracked is introduced into the riser (210) via means which encourage a homogeneous contact between the light feed (212) and the catalyst. These means for introducing the light cut to be cracked (212) may be of the same type as those used to introduce the heavy feed (12) into the principal riser (10).

Optionally, other light cuts (not shown in FIG. 1) may be introduced downstream of the light cut introduction (212) along the length of the additional riser (210) to react with the catalyst as well.

Deactivation of the catalyst is lower with light cuts, essentially because of a smaller deposit of coke, and it is possible, for example, to inject feeds with a higher reactivity downstream of the first injection of light feed (212).

In a preferred variation of the invention shown in FIG. 1, at the outlet from the riser (210), a primary gas-solid separator (220) is installed at the outlet from the additional riser (210).

In FIG. 1, this gas-solid separation system is represented by a cyclone (220), but any other gas-solid separation system may be used, for example a disengagement device such as a tee located at the upper end of the riser (210) may be envisaged and falls within the scope of the reaction zone of the invention.

This separator (220) can generally recover at least 70% of the solid particles which are re-introduced into the principal reactor via the outlet (222) from the separator, close to the level of the fluidized bed of the stripping zone (121) of the principal reactor (100).

The term "proximity" means a distance of approximately 5 meters, preferably approximately 3 meters, above or below the level of the dense bed of the stripping zone (121) of the principal reactor (100).

The cleaned effluents (221) are re-introduced into the dilute phase (110) of the principal reactor (100) at any level of said dilute phase (110), but preferably into the upper portion of said zone.

Since the temperature in the additional riser (210) is generally substantially higher than the temperature in the principal riser (10), injecting a quench fluid (230) can limit the temperature of the effluent (221). This quench fluid is generally introduced into the outlet line of the separation device (220).

It is thus possible to cool the effluents (221) sufficiently to prevent them from thermal degradation downstream of the additional riser (210). The cooled effluents deriving from the additional riser (210) flush the dilute zone (110) of the principal reactor (10) and pass through the openings (26) of the stripping chambers (30) where they join up with gaseous effluent deriving from the principal reactor (100).

Injecting a quench fluid (230) can not only reduce the temperature of the effluents from the additional riser (210) but also can reduce the temperature of the effluents from the principal riser (10) to a satisfactory level, which can reduce the quantity of quench fluid (105) to be injected into the dilute zone (110) of the principal reactor (100). Optionally, in some cases the quench fluid (105) may be dispensed with.

Injecting the quench fluid (230) mixed with the effluents from the additional riser (210) can reduce the temperature of the effluents in the principal riser to that of stripping chamber (30) and not in the lines located downstream of said chamber, as is the case with a fluid (105). This increases the efficiency of mixing between the two gaseous effluents, one "hot" from the principal riser, and the other already cooled, arriving from the additional riser. This advantage is very important as it is then possible to reduce the temperature of the reaction effluents upstream of the stripping chambers (30) more effectively than in the prior art, i.e. without having to vaporize the quench liquid (105), since the effluents from the additional riser which have already been cooled (i.e. the stream (221) supplemented with quench stream (230)) are all in the vapour state.

A further advantage of the invention is that, by dint of this device, the dilute zone (110) of the principal reactor (100) is properly flushed, and its temperature is kept under control by injecting quenching fluid (230). In fact, it is not advisable for the temperature in the dilute zone (110) of the principal reactor to be less than 400° C., as the risks of condensation of the hydrocarbon gaseous effluents considerably increases at this temperature. The advantage of using effluents from the additional riser or risers (210) to flush the dilute phase (110) of the principal reactor is that the temperature of this effluent is sufficiently low to limit thermal degradation because of quench fluid (230) from the outlet from the additional riser or risers is injected, but high enough to limit the risks of condensation of the hydrocarbons. In practice, after injecting the quench fluid (230), the temperature of the effluents from the additional riser or risers is in the range 500° C. to 550° C.

The reaction zone of the invention is improved over the prior art as in the prior art configuration, a flush fluid has to be injected, such as steam (104), to flush the dilute zone (110). However, a low flush steam (104) flow rate generally results in poor flushing of the dilute zone (110) of the reactor (100), and a high flow rate of steam (104) leads to good flushing, but runs the risk of cooling the dilute zone (110) too much. The flush (104) flow rate is thus difficult to adjust in the prior art.

The device of the invention can overcome this disadvantage as the reaction effluents (221) from the additional riser (210) can replace a large proportion, i.e. at least 70%, and preferably at least 80%, of the flush fluid (104). In some cases the flush fluid (104) may even be replaced in its entirety.

Further, the temperature of the flush gas is adjusted by the quantity of the quench fluid (230).

Firstly, the device of the invention can decouple the quantity of flush fluid required to ensure a sufficient flush of the dilute zone (110) of the principal reactor (100).

Secondly, the temperature of the effluents circulating in the dilute zone (110) is essentially controlled by the quench fluid (230).

The general result as a consequence of this is a reduction in the flow rate of the quench fluid (105) in the principal reactor (100) which may be largely replaced, i.e. to an extent of more than 70% and preferably more than 80%, by the quench fluid (230) injected with the effluents (221) from the additional riser or risers.

Figure 2:
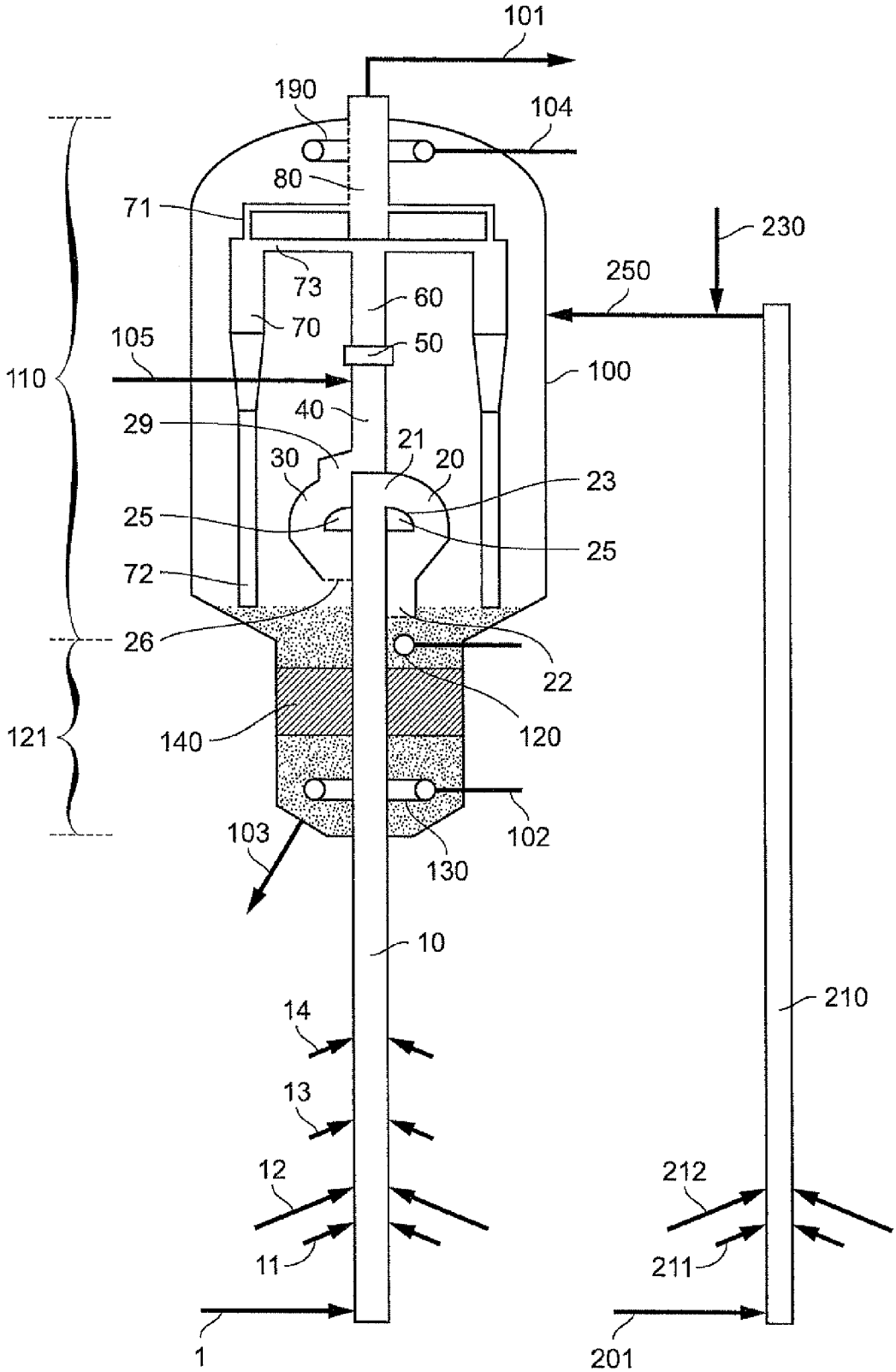
FIG. 2, in accordance with the invention, describes a reaction zone comprising two risers; a principal riser for cracking a heavy cut, and an additional riser for cracking a light cut. The gas and solid effluents from the additional riser are discharged together, without separation, into the dilute phase of the principal reactor.

In FIG. 2, we show another implementation of the invention, the difference between this and the implementation described in FIG. 1 being that the reaction effluents (250) from the additional riser (210) do not undergo primary separation and are sent directly to the dilute zone (110) of the principal reactor (100).

The quench (230) at the outlet from the additional riser (210) is now carried out on the whole of the effluent (250) from the additional riser (210).

Gas-solid separation then naturally occurs by sedimentation in the dilute zone (110) of the principal reactor (100). It is thus necessary to inject larger quantities of quench fluid (230) to arrive at the same temperature in the dilute zone (110), the cooling then involving not only vapours but also the whole of the catalyst circulating in the reaction zone of the additional reactor (210).

EXAMPLES OF THE INVENTION

To illustrate the advantages of implementing the invention, using a process model scaled up from pilot unit experiments, we simulated the performance which would be obtained by carrying out catalytic cracking of a heavy cut the characteristics of which are described in Table 1.

The feed was a non-hydrotreated atmospheric residue at least 90% of which distilled above 360° C.

The density of the residue was 935 kg/m$^3$ and the hydrogen content was 12.1% by weight. The Conradson carbon of the heavy feed was 5.7% by weight.

A heat exchanger (cat cooler) in the regeneration zone was required to make up the thermal balance of the unit.

TABLE 1

| Feed characteristics | | |
|---|---|---|
| Density at 15° C. | 935 | kg/m$^3$ |
| Mean boiling point | 503° | C. |
| Hydrogen content | 12.1% | by weight |
| Sulphur content | 1.67% | by weight |
| Nitrogen content | 0.15% | by weight |
| Conradson carbon | 5.7% | by weight |

The catalyst used in all of the examples was an equilibrium catalyst containing ultra-stable USY zeolite characterized by an active surface area of 150 m$^2$/g with 75% in the zeolite and 25% in the matrix. The heavy metals content in the equilibrium catalyst was 4000 ppm of V and 2000 ppm of Ni.

A number of configurations were simulated to best illustrate the advantages of the invention described in the present application.

Example 1B was in accordance with the prior art as it included just one principal riser which processed the heavy feed of Table 1.

Examples 2B, 3B and 4B were also in accordance with the prior art as they corresponded to processing recycled cuts from the principal riser in an additional riser which was not coupled to the principal riser.

Examples 2C, 3C and 4C were in accordance with the invention as they corresponded to processing recycled cuts derived from the principal riser in an additional riser, this time coupled to the principal riser in accordance with the present invention.

Example 1B

Prior Art

In Example 1B, we simulated catalytic cracking of the heavy feed described in Table 1 using a single reactor, provided at its upper end with a rapid separation system such as that described with reference to FIG. 1.

The values for this example acted as a reference to ascertain the effects of the present invention:

| | | |
|---|---|---|
| Principal riser feed flow rate | 294 | t/h |
| Temperature at principal riser outlet | 545° | C. |
| Temperature at principal riser outlet after quench | 525° | C. |
| Mean temperature of dilute phase | 485° | C. |
| C/O ratio | 5.0 | |
| Gasoline production (C5-220° C.) | 43.9% | by weight |
| Coke production | 8.6% | by weight |
| Propylene production | 4.3% | by weight |
| Total conversion | 70.4% | by weight |
| Quench fluid flow rate, LCO (105) | 16.4 | t/h |
| Flush fluid, steam, flow rate (104) | 2.5 | t/h |
| Heat extracted from regenerator (cat cooler) | 42500 × 10$^6$ | cal/h |

Example 2

Comparative

In Example 2, we simulated catalytic cracking of a heavy feed in the principal riser and catalytic cracking of light cuts in an additional riser, which was either independent of the principal riser (prior art case 2B), or coupled to the principal riser (case 2C, in accordance with the invention) as in the present invention.

The cuts recycled to the additional riser were constituted by the following effluents:

- a C6+220° C. gasoline cut derived from the principal heavy feed conversion riser, 50% of the gasoline produced in the complex constituted by the two reactors being recycled;
- an oligomerized gasoline cut essentially constituted by long olefins containing at least 8 carbon atoms, resulting from oligomerizing all of the C4 and C5 cuts produced in the principal heavy feed conversion reactor.

| | 2B (prior art) | 2C (inv) |
|---|---|---|
| Principal riser fresh feed flow rate | 294 t/h | 294 t/h |
| Light feed recycled to secondary riser, flow rate | 135 t/h | 135 t/h |
| Temperature at principal riser outlet (T1) | 545° C. | 545° C. |
| Additional riser outlet | 590° C. | 590° C. |

-continued

| | 2B (prior art) | 2C (inv) |
|---|---|---|
| temperature (T2) | | |
| Temperature after quench, principal riser (T3) | 525° C. | 525° C. |
| Temperature after quench, additional riser (T4) | 525° C. | 510° C. |
| Mean temperature of dilute phase from principal reactor (T5) | 485° C. | 510° C. |
| Mean temperature of dilute phase of additional reactor | 520° C. | Not relevant |
| C/O ratio, principal riser | 5.1 | 5.2 |
| C/O ratio, secondary riser | 7.5 | 8.0 |
| Gasoline production (C5-220° C.) | 40.1% | 40.3% |
| Coke production | 9.6% | 9.5% |
| Propylene production | 7.4% | 7.9% |
| Total conversion | 69.4% | 70.2% |
| Flow rate of quench fluid (105) in principal reactor | 16.5 T/h | 8.0 T/h |
| Flow rate of quench fluid, additional riser | 27.4 T/h | 36.9 T/h |
| Flow rate of flush fluid (104) in dilute phase around principal riser | 2.5 T/h | 0 T/h |
| Flow rate of flush fluid (104) in dilute phase around additional riser | 2.0 T/h | (0) not relevant |
| Heat extracted at regenerator (cat cooler) | 0 Mcal/h | 0 Mcal/h |

In Example 2, we see that coupling two risers increases both the production of gasoline and the production of propylene. The increase of 0.5 points in propylene, because of the tonnages involved, is highly significant.

It can also be seen that the distribution of the flow of the quench fluid between the principal riser and the additional riser is modified, 82% of the quench fluid being injected into the additional riser, which means that the flush fluid can be dispensed with in case 2C, and termination of the reactions at the outlet from the additional riser can be controlled more effectively.

The temperature after quench (T4) was 510° C. instead of 525° C., while the general outlet temperature (T3) remained at 525° C.

The temperature (T5) of the dilute phase of the principal reactor was now 510° C. instead of 485° C., which meant that a reasonable temperature could be maintained in the dilute phase while keeping the flush flow rate much higher than in case 2B, where the dilute phase was only flushed at 2.5 t/h of vapour.

The flush flow rate corresponded to the feed flow rate for the secondary riser and the quench flow rate of the additional riser, i.e. about 180 t/h.

The flush of the dilute phase around the additional riser was no longer necessary.

A comparison of cases 2B and 2C also show that integrating the rapid separation and quench systems of the invention can increase the circulation of catalyst (C/O) which changed from 5.1 to 5.2 in the principal riser and from 7.5 to 8.0 in the secondary riser.

It can also be seen that it is no longer necessary to use a cat cooler to extract heat from the regenerator as was the case for 1B, cracking of light feeds in the second riser allows sufficient heat to be extracted from the overall reaction zone.

Example 3

Comparative

In Example 3, we simulated catalytic cracking of a heavy feed in the principal riser and catalytic cracking of several light cuts in an additional riser, which was either independent of the principal riser (prior art case 3B), or coupled to the principal riser (case 3C, in accordance with the invention).

The cuts recycled to the additional riser were constituted by the following effluents:

a) a C6+-220 gasoline cut deriving from the principal heavy feed conversion riser, 75% of the gasoline produced in the complex constituted by the two risers being recycled;

b) an oligomerized gasoline cut essentially constituted by long-chain olefins containing at least 8 carbon atoms, resulting from oligomerizing all of the C4 and C5 cuts produced in the principal heavy feed conversion reactor;

c) 50% of the LCO cut, with a distillation range of 220° C. to 360° C., produced by the reaction zone constituted by the two risers.

| | 3B (prior art) | 3C (inv) |
|---|---|---|
| Principal riser fresh feed flow rate | 294 t/h | 294 t/h |
| Light feed recycled to secondary riser, flow rate | 230 t/h | 230 t/h |
| Temperature at principal riser outlet (T1) | 545° C. | 545° C. |
| Additional riser outlet temperature (T2) | 590° C. | 590° C. |
| Temperature after quench, principal riser (T3) | 525° C. | 525° C. |
| Temperature after quench, additional riser (T4) | 525° C. | 510° C. |
| Mean temperature of dilute phase from principal reactor (T5) | 485° C. | 510° C. |
| Mean temperature of dilute phase of additional reactor | 520° C. | Not relevant |
| C/O ratio, principal riser | 8.8 | 9.3 |
| C/O ratio, secondary riser | 13.7 | 14.6 |
| Gasoline production (C5-220° C.) | 31% | 30.9% |
| Coke production | 12.4% | 12.1% |
| Propylene production | 16.1% | 17.2% |
| Total conversion | 82.6% | 82.8% |
| Flow rate of quench fluid (105) in principal reactor | 18.6 T/h | 3.6 T/h |
| Flow rate of quench fluid (230), additional riser | 50.4 T/h | 64.2 T/h |
| Flow rate of flush fluid (104) in dilute phase around principal riser | 2.5 T/h | 0 T/h |
| Flow rate of flush fluid (104) in dilute phase around additional riser | 2.0 T/h | (0) not relevant |

In Example 3, we see that coupling two risers increases both the production of gasoline and the production of propylene. The increase of 1.1 points in propylene, because of the tonnages involved, is highly significant.

It can also be seen that the distribution of the flow of the quench fluid between the principal riser and the additional riser is modified.

The temperature (T5) of the dilute phase of the principal reactor was now 510° C. instead of 485° C., which meant that the temperature could be kept to a reasonable level in the dilute phase while having a much higher flush rate than in case 3B, where the dilute phase was only flushed with 2.5 t/h of vapour.

The flush flow rate corresponded to the feed flow rate for the secondary riser and the quench flow rate of the additional riser, i.e. about 295 t/h.

The flush of the dilute phase around the additional riser was no longer necessary.

A comparison of cases 3B and 3C shows that integrating the rapid separation and quench systems of the invention can increase the circulation of catalyst in the principal riser because of the LCO recycle (C/O changed from 8.8 to 9.3) and can increase the amount of catalytic cracking in the principal riser and in the secondary riser (C/O changing from 13.7 to 14.6).

It will also be seen that it is no longer necessary to use a cat cooler to extract heat from the regenerator as was the case for 1B, as cracking of light feeds in the second riser allows sufficient heat to be extracted from the overall reaction zone.

Example 4

Comparative

In Example 4, we simulated catalytic cracking of a heavy feed in the principal riser and catalytic cracking of several light cuts in an additional riser, which was either independent of the principal riser (prior art case 4B), or coupled to the principal riser (case 4C, in accordance with the invention) as in the present invention. The cuts recycled to the additional riser were constituted by the following effluents:

- a C6+220° C. gasoline cut deriving from the principal heavy feed conversion riser, 25% of the gasoline produced in the complex constituted by the two reactors being recycled (as opposed to 50% in Example 2);
- an oligomerized gasoline cut essentially constituted by long chain olefins containing at least 8 carbon atoms, resulting from oligomerizing all of the C4 and C5 cuts produced in the principal heavy feed conversion reactor;
- a hydrocarbon cut constituted by a soya oil, a C18 triglyceride structure, with an olefinicity of 53% of chains supplied to the second riser at a flow rate of 62 t/h.

Under these conditions, the flow rate of light hydrocarbons in the second riser was constant and was constituted by 73 t/h of gasoline from FCC and the oligomerization of C4-C5 olefins to polynaphtha and 62 t/h of soya oil.

| | 4B (prior art) | 4C (inv) |
|---|---|---|
| Principal riser fresh feed flow rate | 294 t/h | 294 t/h |
| Light feed recycled to secondary riser, flow rate | 73 t/h | 73 t/h |
| Fresh feed flow rate to secondary riser | 62 t/h | 62 t/h |
| Temperature at principal riser outlet (T1) | 545° C. | 545° C. |
| Additional riser outlet temperature (T2) | 590° C. | 590° C. |
| Temperature after quench, principal riser (T3) | 525° C. | 525° C. |
| Temperature after quench, additional riser (T4) | 525° C. | 510° C. |
| Mean temperature of dilute phase from principal reactor (T5) | 485° C. | 510° C. |
| Mean temperature of dilute phase of additional reactor | 520° C. | Not relevant |
| C/O ratio, principal riser | 4.9 | 5.1 |
| C/O ratio, secondary riser | 7.2 | 7.7 |
| Gasoline production (C5-220° C.) | 42.1% | 42.4% |
| Coke production | 9.7% | 9.6% |
| Propylene production | 6.9% | 7.4% |
| Flow rate of quench fluid (105) in principal reactor | 16.3 T/h | 7.8 T/h |
| Flow rate of quench fluid, additional riser | 27.1 T/h | 36.6 T/h |
| Flow rate of flush fluid (104) in dilute phase around principal riser | 2.5 T/h | 0 T/h |
| Flow rate of flush fluid (104) in dilute phase around additional riser | 2.0 T/h | (0) not relevant |
| Heat extracted at regenerator (cat cooler) | 0 Mcal/h | 0 Mcal/h |

In Example 4, we see that coupling two risers also increases both the production of gasoline and the production of propylene. The increase of 0.5 points in propylene, because of the tonnages involved, is highly significant.

It can also be seen that the distribution of the flow of the quench fluid between the principal riser and the additional riser is modified, 82% of the quench fluid being injected into the additional riser, which means that the flush fluid can be dispensed with in case 4C, and the end of the reactions at the outlet from the additional riser can be controlled more effectively.

The temperature (T4) after quench was 510° C. instead of 525° C., while the general outlet temperature (T3) remained at 525° C.

The temperature (T5) of the dilute phase of the principal reactor was now 510° C. instead of 485° C., which meant that a reasonable temperature could be maintained in the dilute phase while keeping the flush flow rate much higher than in case 4B, where the dilute phase was only flushed at 2.5 t/h of vapour.

The flush flow rate corresponded to the feed flow rate for the secondary riser and the quench flow rate for the additional riser, i.e. about 180 t/h.

The flush of the dilute phase around the additional riser was no longer necessary.

A comparison of cases 4B and 4C further shows that integrating the rapid separation and quench systems of the invention can increase the circulation of catalyst, the C/O changing from 4.9 to 5.1 in the principal riser and from 7.2 to 7.7 in the secondary riser.

It can also be seen that it is no longer necessary to use a cat cooler to extract heat from the regenerator as was the case for 1B, as cracking of light feeds in the second riser allows sufficient heat to be extracted from the overall reaction zone.

The invention claimed is:

1. A process for producing propylene from a heavy catalytic cracking feed and at least one light feed constituted by a light gasoline (C5-150° C.), in a reaction zone, said process comprising:

- in a principal riser (10) of a principal reactor (100), conducting catalytic cracking of said heavy feed;
- in one or more additional risers (210), operating at higher severity than the principal riser (10), conducting catalytic cracking of light feeds including said at least one light feed constituted by a light gasoline (C5-150° C.), said additional riser or risers (210) operating in parallel with the principal riser (10), and passing resultant gaseous and solid effluents from said additional riser or risers (210) to a dilute zone (110) located in an upper part of the principal reactor (100),
- introducing a quench fluid into said dilute zone (110) of said principal reactor (100) to quench effluents from said principal riser, and
- introducing a flush fluid into an upper part of said dilute zone (110) to flush said dilute zone, wherein:

a) at least 70% by weight of said quench fluid (230) is injected into the principal reactor (100) with effluents (221) from said additional riser or risers (210); and b) at least 70% by weight of said flush fluid (104) is made up of reaction effluents (221) derived from said additional riser or risers (210), c) a temperature (T5) of the dilute phase in said dilute zone (110) of said principal reactor (100) is 490° C. to 520° C., d) a residence time of materials in the principal reactor (100), measured from introduction of the heavy feed into the bottom of the principal riser (10) to the discharge of reaction effluents from the principal reactor (100), is less than 10 seconds, and e) said at least one light feed constituted by a light gasoline (C5-150° C.) contains at least 30% by weight olefins.

2. The process according to claim 1, wherein effluents from the additional riser or risers (210) are initially separated into a mainly gaseous phase containing the reaction effluents (221), and a mainly solid phase containing cracking catalyst (222), and wherein said gaseous phase is sent to said dilute zone (110) of said principal reactor (100), and said solid phase being sent to a dense zone (121) of said principal reactor (100).

3. The process according to claim 1, in which the flow in the principal riser and said additional riser or risers is a vertical downflow.

4. The process according to claim 1, wherein at the outlet from the principal riser (10) of the principal reactor (100), gaseous hydrocarbons and catalyst are separated in a rapid separation device (20, 30) comprising an arrangement of one or more separation chambers (20) alternating with one or more stripping chambers (30) disposed around the upper end of said principal riser (10), and wherein the gas, constituted by stripping vapor (102, 120) introduced into a dense zone (121) of said principal reactor (100) and desorbed hydrocarbons, pass through openings (26) for said stripping chambers (30) with an upflow velocity through said openings (26) in the range of 1 m/s to 5 m/s.

5. The process according to claim 4, wherein said upflow velocity is in the range of 1.5 to 4 m/sec.

6. The process according to claim 4, wherein the velocity of gas-solid mixture in an inlet section (21) of said separation chambers (20) is 10 m/s to 40 m/s.

7. The process according to claim 4, wherein the velocity of gas-solid mixture in an inlet section (21) of said separation chambers (20) is 15 m/s to 25 m/s.

8. The process according to claim 4, wherein the surface flow rate of catalyst in an outlet section (22) of said separation chambers (20) is 10 $kg/s \cdot m^2$ to 300 $kg/s \cdot m^2$.

9. The process according to claim 4, wherein the surface flow rate of catalyst in an outlet section (22) of said separation chambers (20) is 50 $kg/s \cdot m^2$ to 200 $kg/s \cdot m^2$.

10. The process according to claim 4, wherein gas leaves the separation chamber (20) laterally via an opening (25) which communicates with an adjacent stripping chamber (30) and the velocity of the gas through the opening (25) is 10 m/s to 40 m/s.

11. The process according to claim 10, wherein the velocity of the gas through the opening (25) is 15 m/s to 30 m/s.

12. The process according to claim 1, wherein at least 80% by weight of the molecules of said at least one light feed constituted by a light gasoline have a boiling point of less than 340° C.

13. The process according to claim 1, in which said feed for at least one of the additional risers is an oligomerized gasoline produced from light C4 or C5 olefins derived from the principal riser.

14. The process according to claim 1, in which said light feeds for at least one of the additional risers includes a vegetable oil or an animal fat or any mixture of vegetable oil and animal fat.

15. The process according to claim 1, wherein at least 80% by weight of said quench fluid (230) is injected into the principal reactor (100) with effluents (221) from said additional riser or risers (210).

16. The process according to claim 1, wherein at least 80% by weight of said flush fluid (104) is made up of reaction effluents (221) derived from said additional riser or risers (210).

17. The process according to claim 1, wherein positioned within said dilute zone (110), located in said upper part of the principal reactor (100), are:

a) the upper portion of the principal riser (10) which is terminated by a rapid separation system (20, 30) followed by a secondary separation system (70);

b) a device for injecting quench fluid (105) located between the rapid separation system and the secondary separation system; and c) a device for injecting flush fluid (104) located in the upper portion of the dilute phase (110); and the lower part of said principal reactor (100) contains a dense phase zone (121) wherein catalyst is stripped.

18. The process according to claim 1, wherein prior to said at least 70% by weight of said quench fluid (230) being injected into the principal reactor (100) with effluents (221) from said additional riser or risers (210), the effluents (221) from said additional riser or risers (210) pass through a gas-solid separation system and then said at least 70% by weight of said quench fluid (230) is combined with the resultant effluents from the gas-solid separation system before the combined streams are injected into the principal reactor (100).

19. The process according to claim 18, wherein catalyst particles separated by said gas-solid separation system of said additional riser or risers (210) are introduced into a fluidized bed of a stripping zone (121) located in the lower part of said principal reactor (100).

20. The process according to claim 18, wherein said at least 70% by weight of said quench fluid (230) is introduced into an outlet line of said gas-solid separation system (220).

21. The process according to claim 1, wherein at the outlet from the principal riser (10) of the principal reactor (100), gaseous hydrocarbons and catalyst are separated in a rapid separation device (20, 30) comprising an arrangement of one or more separation chambers (20) alternating with one or more stripping chambers (30) disposed around the upper end of said principal riser (10), and said flush fluid (104), at least 70% by weight of which is made up of reaction effluents (221) derived from said additional riser or risers (210), flush the dilute zone (110) of said principal reactor (10) and pass through the openings (26) of the stripping chambers (30) where they are combined with gaseous effluent deriving from the principal reactor (100).

22. The process according to claim 1, wherein said additional riser or risers (210) is external to said principal reactor (100).

* * * * *

UNITED STATES PATENT AND TRADEMARK OFFICE

CERTIFICATE OF CORRECTION

PATENT NO. : 8,491,781 B2
APPLICATION NO. : 12/666129
DATED : July 23, 2013
INVENTOR(S) : Gauthier et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 792 days.

Signed and Sealed this
Eighth Day of September, 2015

Michelle K. Lee

Michelle K. Lee
*Director of the United States Patent and Trademark Office*